US012687035B2

(12) United States Patent
Kim

(10) Patent No.: US 12,687,035 B2
(45) Date of Patent: Jul. 21, 2026

(54) CAP SHAPED TENT AND MOSQUITO NET

(71) Applicant: Young Ha Kim, Seoul (KR)

(72) Inventor: Young Ha Kim, Seoul (KR)

( * ) Notice: Subject to any disclaimer, the term of this patent is extended or adjusted under 35 U.S.C. 154(b) by 178 days.

(21) Appl. No.: 18/817,882

(22) Filed: Aug. 28, 2024

(65) Prior Publication Data

US 2024/0417998 A1 Dec. 19, 2024

Related U.S. Application Data

(63) Continuation of application No. PCT/KR2022/003398, filed on Mar. 10, 2022.

(51) Int. Cl.

| | |
|---|---|
| ***E04H 15/00*** | (2006.01) |
| ***E04H 15/20*** | (2006.01) |
| ***E04H 15/56*** | (2006.01) |
| ***E04H 15/58*** | (2006.01) |

(52) U.S. Cl.

CPC ..... *E04H 15/20* (2013.01); *E04H 15/56* (2013.01); *E04H 15/58* (2013.01); *E04H 2015/201* (2013.01); *E04H 2015/206* (2013.01)

(58) Field of Classification Search

CPC ..... E04H 15/00; E04H 15/02; E04H 15/12; E04H 15/18; E04H 15/32; E04H 15/34; E04H 15/54; E04H 15/56; A45F 3/52; A45F 4/04; A47C 29/006

USPC ..... 135/137, 150, 116, 120.1

See application file for complete search history.

(56) References Cited

U.S. PATENT DOCUMENTS

| | | | | |
|---|---|---|---|---|
| 3,586,013 A * | 6/1971 | Gladden | A45F 1/00 135/1 |
| 6,109,281 A * | 8/2000 | Lowenthal | E04H 15/40 135/125 |
| 8,776,812 B1 * | 7/2014 | Forget | E04H 15/56 135/96 |
| 2002/0117197 A1 * | 8/2002 | Pearcy | E04H 15/02 135/120.1 |

FOREIGN PATENT DOCUMENTS

| | | |
|---|---|---|
| JP | H0583222 U | 11/1993 |
| JP | 2018021447 A | 2/2018 |
| KR | 101504529 B1 | 3/2015 |
| KR | 200480022 Y1 | 4/2016 |
| KR | 1020220092094 A | 7/2022 |

* cited by examiner

*Primary Examiner* — Joshua J Michener
*Assistant Examiner* — Henry Hooper Mudd
(74) *Attorney, Agent, or Firm* — Dinsmore & Shohl LLP; Yongsok Choi, Esq.

(57) ABSTRACT

A cap-shaped tent and a mosquito net are provided. A storage package structure is improved so that the setting-up and breaking-down of a tent can be carried out easily and rapidly as compared with the existing structure and the concern of losing the storage package can be reduced. In addition, because the storage package can be utilized as a peripheral bottom mat for the tent, issues caused when the mat is separately provided can be addressed. A folding structure of the tent is improved so that the breaking-down of the tent can be carried out rapidly, and the tent can be rapidly and easily put into the improved storage package, so that convenience in use can be improved. The support structure for the tent is improved so that the setting-up and breaking-down of the tent can be carried out easily and rapidly while ensuring and maintaining a sufficient support force.

7 Claims, 19 Drawing Sheets

(a)

(b)

(c)

(d)

CAP SHAPED TENT AND MOSQUITO NET

CROSS-REFERENCE TO RELATED APPLICATION

This application is a continuation of International Application No. PCT/KR2022/003398 filed on Mar. 10, 2022, the entire contents of which are herein incorporated by reference.

TECHNICAL FIELD

The present disclosure relates to tents and mosquito nets, and pertains to a technology field to improve a storage package structure such that assembling and disassembling of tents may be made easier than the related art, not only the risk of loss of a storage package may be minimized, but also the storage package may be utilized as an additional functional purpose of tents, thereby enhancing the convenience.

In addition, the present disclosure pertains to a technology field to improve folding structure of tents such that disassembling of the tent may be quickly and easily made, and at the same time, tents may be quickly and easily stored in the corresponding storage package.

In addition, the present disclosure pertains to a technical field to improve the support structure of tents such that the ease of assembling and disassembling of tents may be enhanced while a sufficient support force may be secured, thereby minimizing the possibility of unnecessary shape deformation due to external forces.

BACKGROUND ART

Recently, interest in camping has been increasing, and improvements to functions of tents, which is one of the most basic camping equipment, has been actively made.

General tents are largely divided into prefabricated tents and integrated tents according to assembling and disassembling methods.

The prefabricated tent is the most common type of tent, in which tent cloth and poles, which are the basic elements constituting the tent, are provided separately, when prefabricated, the poles are joined to the tent cloth to form the shape of the tent, when disassembled, the poles are separated from the tent cloth and then the tent cloth is folded and stored together with the poles.

The prefabricated tent has the advantage of having a sturdy structure compared to the integrated tent to be described below, because the prefabricated tent is implemented by joining several poles to form a tent frame. However, the prefabricated tent has the disadvantage of not being easy to assemble and disassemble because a prefabrication/separation process between the poles and a prefabrication/separation process between the poles and the tent cloth are cumbersome and difficult.

Also, because the poles are separated from the tent cloth, the prefabricated tent has the disadvantage of being more highly likely to be lost and damaged during a storage and transportation process.

In addition, the prefabricated tent is accommodated in a separate storage package when stored after assembling. In the related art, the storage package was used only for tent storage and was not used for additional functions related to tent use.

Therefore, because the storage package must always be stored separately when using the tent, there is a high possibility of loss of the storage package.

The integrated tent has a support frame, which corresponds to the poles of the prefabricated tent, integrated with the tent cloth. The support frame itself is easily bent by external force, but is easily restored to its shape by elastic force, and thus, the integrated tent has the advantage that a tent assembling and disassembling process may be done quickly and easily with the so-called 'one-touch method'.

On the other hand, because the support frame of the integrated tent bends and restores too easily, the integrated tent does not have a large support force, and thus, there are problems that the entire tent is easily shaken by the wind, which makes it difficult to apply to large tents and is applied to a small structure.

In addition to these points, the prefabricated tent and the integrated tent of the related art commonly used for purposes such as reducing contamination of shoes or feet when entering or leaving the tent by spreading a separate mat around the tent, especially in front of the entrance. However, because the mats of the related art need to be provided separately from the tent, it is cumbersome to be provided and use.

In addition, because the mat needs be provided separately, there is a high risk of loss of the mat, and because the mat is used simply by spreading out on the ground, there are inconveniences such as the mat being moved or folded when a user repeatedly steps on the mat.

Also, because the mats of the related art do not perform any functions other than the basic function of the mat, the motivation for separate provision is weak, which may ultimately cause a decrease in convenience due to non-provision.

DISCLOSURE

Technical Problem

The present disclosure is designed to simultaneously solve the individual problems and the common problems of tents of the related art, and therefore the present disclosure is to improve a storage package structure such that assembling and disassembling of a tent may be made easier and faster than the related art, not only the risk of loss of a storage package may be reduced, but also the storage package may be utilized as a floor mat around the tent, thereby simultaneously solving problems caused by separate provision.

In addition, in this regard, the present disclosure is to improve a folding structure of the tent such that disassembling of the tent may be quickly made, and the tent may be quickly and easily stored in the improved storage package, thereby enhancing the convenience of use.

In addition, the present disclosure is to improve a support structure of the tent such that assembling and disassembling of the tent may be easily and quickly made while a sufficient support force may be secured and maintained, thereby simultaneously improving the convenience and stability.

Technical Solution

There is provided a cap shaped tent and mosquito net including a tent main body located in a shape surrounding a usable space in a center and having entrances and opening and closing doors for opening and closing the usable space formed in side portions, support frames in the shape of a bar and connected to each other in the shape of surrounding the usable space while contacting a surface of the tent main body and supporting the tent main body, and a mat-type storage package located in an unfolded shape on a ground outside the entrances of the tent main body, and having one side portion connected to be separable from the tent main body and a storage space formed inside, wherein the tent main body is stored in the storage space of the mat-type storage package in a folded state.

Also, the mat-type storage package may include a mat main body in which the storage space is formed, mat connecting members formed on side portions of the mat main body and connecting the mat main body to the tent main body to be separable, and an opening and closing member formed on an edge of the mat main body to open and close the storage space.

In addition, the mat-type storage package may include handle portions formed by folding a part of the mat main body and a storage portion in which the storage space is formed.

Also, a point of the tent main body connected to the mat main body may form a convex curved portion so as to protrude convexly toward the outside, the mat-type storage package may have a concave curved portion formed at a point of the edge of the mat main body connected to the convex curved portion of the tent main body so as to be in close contact with the convex curved portion, first mat folding line in the shape that crosses the concave curved portion in a transverse direction may be formed, sections on an upper surface of the mat main body facing the tent main body with respect to the first mat folding lines may be handle portion formation sections folded in the opposite direction with respect to the first mat folding lines, second mat folding lines may be formed from both intersections between the first mat folding lines and the concave curved portion on the upper surface of the mat main body in a direction perpendicular to the first mat folding lines, a section between both the second mat folding lines on the upper surface of the mat main body may be a storage portion formation section, first detachable members may be formed on upper surfaces of both end points of the concave curved portion in the handle forming section on the upper surface of the mat main body, second detachable members coupled to be separable from the first detachable members may be formed at points facing the first detachable members when the handle forming section on the upper surface of the mat main body is folded with respect to the first mat folding lines, when the first fastening members and the second fastening members are fastened to each other, the handle portion formation sections may be two handle portions in the shape of a ring, the storage portion formation section located between the both second mat folding lines when the mat main body is rotated and folded toward each other with respect to both second mat folding lines may be the storage portion, and the opening and closing member may be formed in a section of the edge of the mat main body including a part where the storage portion is formed.

In addition, a point of the tent main body connected to the mat main body may form a convex curved portion so as to protrude convexly toward the outside, first coupling members may be formed on both surfaces with the convex curved portion therebetween, the mat-type storage package may have a concave curved portion formed at a point of the edge of the mat main body connected to the convex curved portion of the tent main body so as to be in close contact with the convex curved portion, and may further include second coupling members connected to be separable from the first coupling members at both ends of the concave curved portion facing the tent main body, and third coupling members formed at points on an upper surface of the mat main body opposite to both second coupling members and fastened to be separable from the second coupling members, virtual mat folding lines may be formed in the shape of crossing the concave curved portion in a transverse direction at middle points of the second coupling members and the third coupling members on an upper surface of the mat main body, and while the second coupling members are separated from the first coupling members, when points on the upper surface of the mat main body facing the tent main body with respect to the mat folding lines are rotated and folded with respect to the mat folding lines, sections between the second coupling members and the third coupling members on the upper surface of the mat main body may form handle portions in the shape of a ring.

Also, the cap shaped tent and mosquito net may further include a central frame coupling portion located at an upper center of the tent main body and having fastening portions formed on an edge in all directions, the support frames may be simultaneously connected to and support side and upper surfaces of the tent main body, have upper ends fastened to the fastening portions of the central frame coupling portion, and may be located in the shape of extending in all directions with respect to the central frame coupling portion.

In addition, the central frame coupling portion may have a main air injection/discharge port formed in one side, and an air distribution space communicating with the main air injection/discharge port formed inside, and the fastening portions may be in the shape of a nozzle communicating with the air distribution space and discharging air, each of the support frames may be in the shape of an air tube with an air filling space formed therein, and an air inflow hole formed in an upper end may be communicatively connected to each of the fastening portions, and external air supplied through the main air injection/discharge port may be supplied to each of the support frames through the air distribution space, each of the fastening portions, and the air inflow hole such that a volume of each of the support frames expands to support the tent main body.

Also, individual air injection/discharge ports capable of directly injecting air into the air filling space may be further formed on side portions of each of the support frames.

In addition, the support frames may be in the shape of a multi-tube including a first tube having a first air filling space formed therein and connected to each of the fastening portions of the central frame coupling portion, and a second tube surrounding the first tube, having a second air filling space formed inside, and connected to each of the fastening portions of the central frame coupling portion, and the air inflow hole is divided into a first air inflow hole formed in the first tube and connected to each of the fastening portions of the central frame coupling portion, and a second air inflow hole formed in the second tube and connected to each of the fastening portions of the central frame coupling portion.

Also, the tent main body may further include, based on that a first tent folding line and a third tent folding line are formed from a central point of an upper end to lower ends of one side and the other side, a second tent folding line and a fourth tent folding line are formed to the lower ends of one side and the other side in the shape of intersecting each other at points left-right symmetrical with the first tent folding line and the third tent folding line, a first folding fixing member and a second folding fixing member located at both sides of an outer surface of the tent main body with the first tent folding line therebetween and fastened to and separated from each other, a third folding fixing member and a fourth folding fixing member located at both sides of the outer surface of the tent main body with the second tent folding line therebetween and fastened to and separated from each other, a fifth folding fixing member and a sixth folding fixing member located at both sides of the outer surface of the tent main body with the third tent folding line therebetween and fastened to and separated from each other, and a seventh folding fixing member and an eighth folding fixing member located at both sides of the outer surface of the tent main body with the fourth tent folding line therebetween and fastened to and separated from each other.

When the tent main body is folded with respect to the first tent folding line, the second tent folding line, the third tent folding line, and the fourth tent folding line, the first to eighth folding fixing members may be fastened to each other, and the tent main body may be entirely disassembled in the shape of being sequentially folded from the lower end to the upper end and then stored in the storage space of the mat-type storage package.

Advantageous Effects

According to the present disclosure having the technical solutions described above, the storage package of the tent may be integrally connected to the tent main body through a connecting member in a process of using the tent and used as the floor mat outside the entrance, and, upon disassembling the tent, immediately utilized as the storage package, and thus, there is the effect of minimizing the inconvenience and the risk of loss as a mat and a packaging package are separately provided and used in the related art.

In addition, the mat type storage package has the storage portion and the handle portion which are formed by using a simple folding method through the concave curved portion, the first and second mat folding lines, and the first and second detachable members so that the mat type storage package may be transformed into the shape of a bag as a whole, and thus, there is the effect of increasing the convenience of use.

In addition, the support frames are assembled by fastening with the central frame coupling portion assembled in the center of the tent main body, and thus, there is the effect of simplifying and easily achieving the assembling process of the entire tent, including the support frames.

In addition, when each of support frames is implemented in the shape of the air tube, it is possible to assemble and disassemble the tent only by expanding and contracting through the injection and discharge of air, and thus, there are the effects that assembling and disassembling of the tent may be much easier and the weight of the tent may be lighter than the prefabricated tents of the related art, as well as robustness of the tent may increase compared to the prefabricated tents of the related art.

In addition, when each of support frames is implemented in the shape of the air tube, because the central frame coupling portion is used for distribution supply, and discharge of air, air supply and discharge with respect to each of support frames may be simultaneously made, and thus, there is the effect that the entire tent assembling process may be easily and quickly made.

In addition, as a separate air injection/discharge port is formed for each of support frames in addition to the central frame coupling portion, air injection and air discharge with respect to each of support frames may be more quickly made, and even if the central frame coupling portion is damaged, there is the effect of maintaining smooth air injection and discharge functions.

Also, when each of support frames is implemented in the shape of the multi-tube, even if the first tube is damaged and air in the first air filling space is lost, the support force of the tent may be maintained by the internal second tube, and thus, even if the support frame is implemented in the shape of the air tube, there is the effect of preventing a phenomenon such as loss of function of the support frame due to damage.

In addition, by forming the first to fourth tent folding lines and the first to eighth folding fixing members in the tent main body, when disassembling the tent, a user may simply fold the tent main body along each folding line sequentially and fasten the tent main body with each folding fixing member such that folding disassembling of the tent main body may be made, and thus, there is the effect that disassembling of the tent is easy compared to the prefabricated tents of the related art.

BRIEF DESCRIPTION OF DRAWINGS

FIGS. 1 to 9 are diagrams according to a first embodiment, in which:

FIG. 1 is an exploded perspective view between a tent main body and a mat-type storage package;

FIG. 2 is a combined perspective view of FIG. 1;

FIG. 3 is a perspective view showing each opening and closing door is open;

FIG. 4 is a side view of FIG. 3;

FIG. 6 is a side cross-sectional view of FIG. 5;

FIG. 7 is a plan view of FIG. 5; and

FIGS. 10 and 11 are diagrams of a second embodiment, in which:

FIG. 10 is a front sectional view showing a tent main body to which a central frame coupling portion is applied; and FIG. 11 is a perspective view showing a coupling structure between the central frame coupling portion and a support frame;

FIGS. 12 to 14 are diagrams according to a third embodiment, in which:

FIG. 12 shows an entire cross-sectional view;

FIG. 13 is a partial plan sectional view showing a coupling structure and air supply process between a central frame coupling portion and each of support frames and an air supply process; and FIG. 14 is a partial plan sectional view showing each of support frames that is not filled with air;

FIGS. 16 to 19 are diagrams of a fifth embodiment, in which:

FIG. 16 is a perspective view showing a tent main body on which each tent folding line that is formed;

FIG. 17 is a schematic plan view of FIG. 16;

FIG. 18 is a schematic plan view showing a tent main body folded with respect to each tent folding line.

MODE FOR DISCLOSURE

Figure 1:
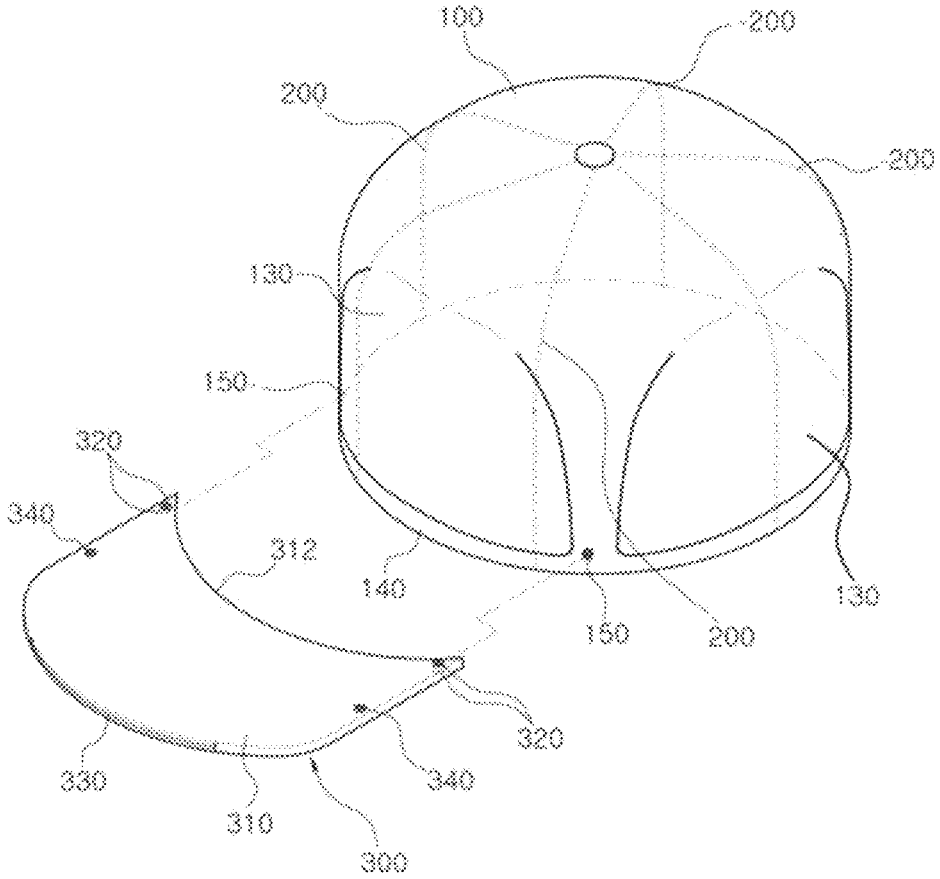
Figure 2:
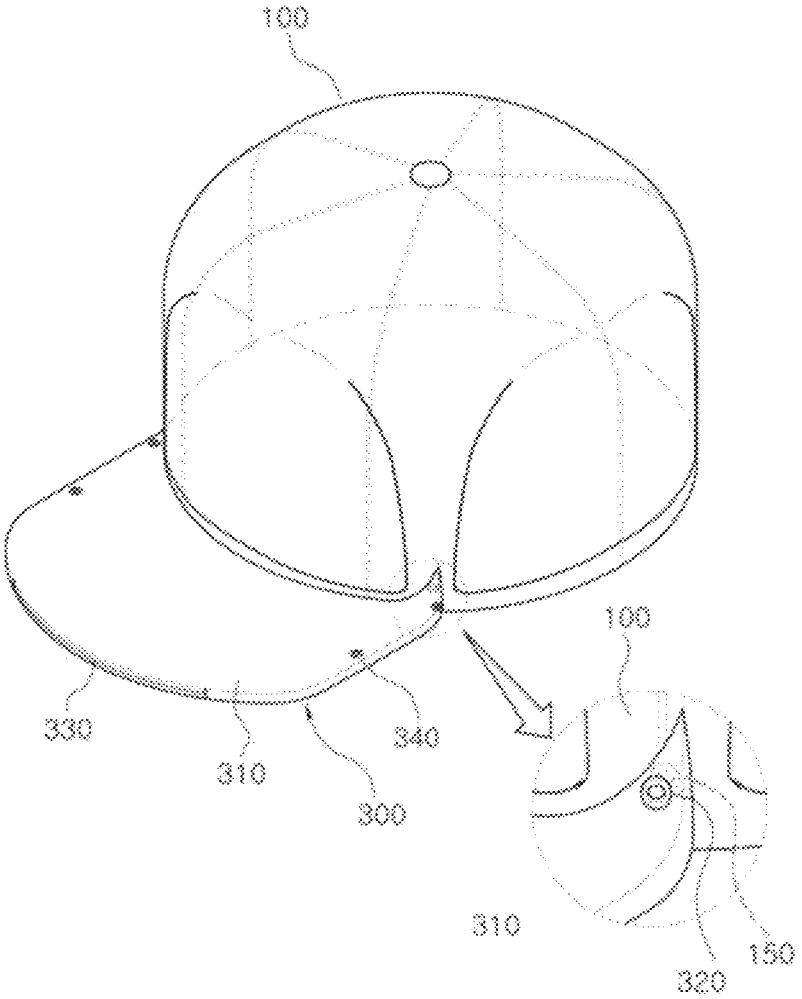
Figure 3:
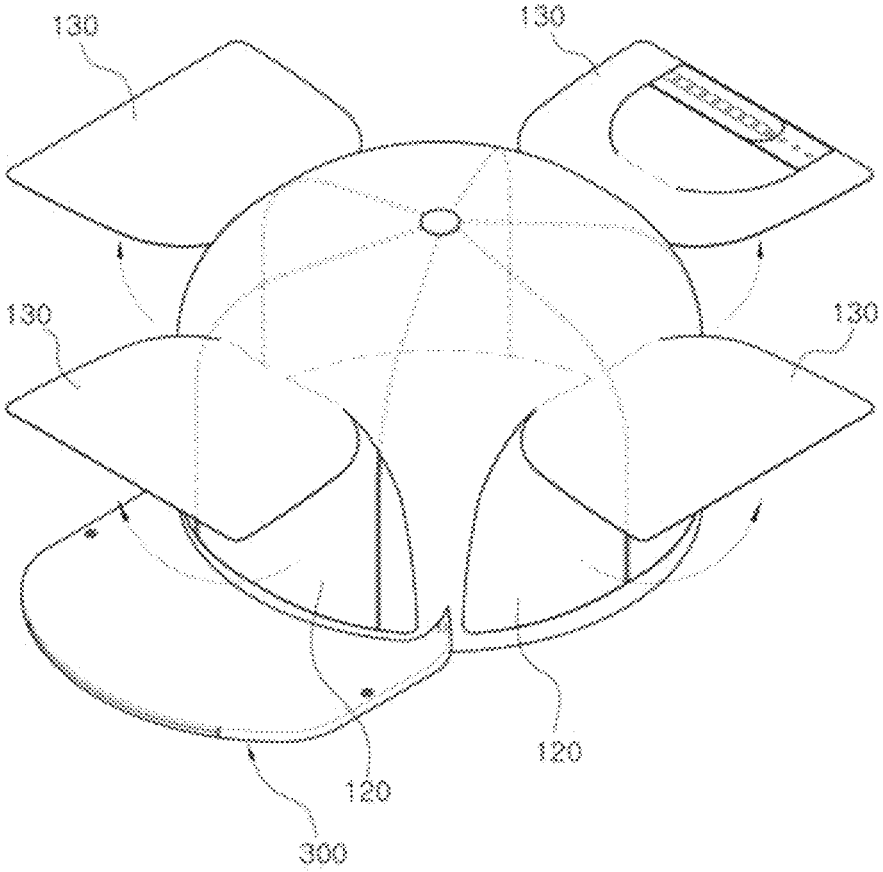
Figure 4:
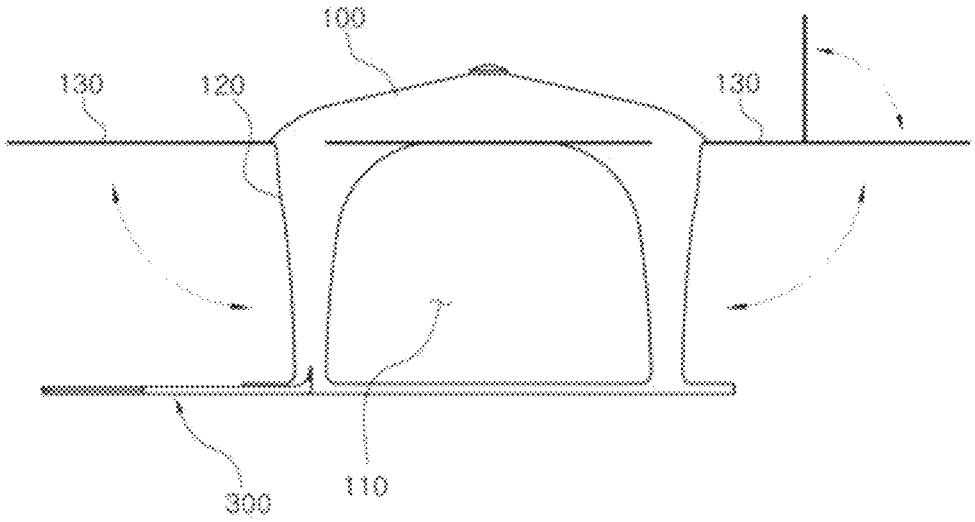

Hereinafter, more detailed configurations and operations of the present disclosure will be described with reference to embodiments illustrated in the drawings.

First Embodiment

As shown in [FIG. 1] to [FIG. 9], the present embodiment largely includes a tent main body 100, support frames 200, and a mat-type storage package 300.

First, the tent main body 100 serves to provide an indoor space for a user, which is the substantial function of a tent, and includes tent cloth of a waterproof material used in general outdoor tents.

For reference, the material of the tent main body 100 is not limited to a specific material and may be selected and applied in various forms as long as it has a simple screen function or a shape capable of protecting the inside of the tent main body 100 from the outside.

Figure 20:
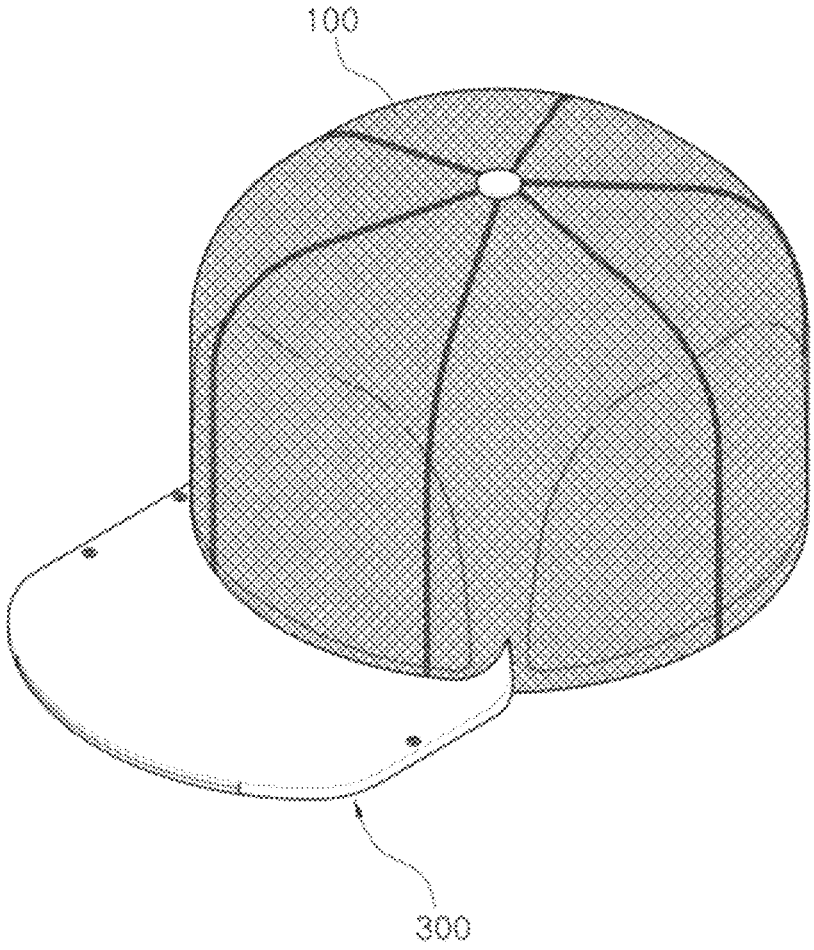
FIG. 20 is a perspective view showing the tent main body implemented in the shape of an insect screen.

For example, as shown in [FIG. 20], the entire mesh structure, that is, a shape such as an insect screen, may be applied. In this case, the present disclosure may also be utilized as a mosquito net.

The tent main body 100 forms a specific shape such as a dome through the support frames 200 to be described below and has a usable space 110 formed inside. The tent main body 100 assembled while forming the specific shape has the usable space 110 for residence of users formed inside, entrances 120 for entry of users formed in the side portion, and opening and closing doors 130 respectively connected to the entrances 120.

At this time, a convex curved portion 140 that protrudes convexly toward the outside is formed on the side portion of the tent main body 100, and mat connecting members 150 for connection to the mat-type storage package 300 to be described below is formed on the convex curved portion 140 in the shape of a snap button or a Velcro tape.

For reference, the drawings show that entrances and opening and closing doors are formed on all front/rear/left/right sides of the main body, but the number and locations of entrances and opening and closing doors are not limited thereto and may be modified and implemented in various ways.

As mentioned above, the separate support frames 200 are connectively assembled on the tent main body 100.

The support frames 200 serve as a framework to form and maintain the shape of the tent main body 100, are in the shape of a bar with an overall certain length, and are connectively assembled on the tent main body 100 so as to contact the outer or inner surface of the tent main body 100 to support the shape of the tent main body 100.

The support frames 200 may be connected to the tent main body 100 through a separate link, etc. while being separated from the tent main body 100, and may be assembled by being inserted and embedded into the tent main body 100.

At this time, the support frames 200 cross upper and side surfaces of the tent main body 100 and are disposed in all directions around the upper center of the tent main body 100 such that the support force may be applied to the tent main body 100 as a whole.

For reference, a support frame structure in the present disclosure is not limited to a specific structure and may be selected and applied in various ways as long as it may exert the support force to maintain the shape of the tent main body 100, such as a pole used in prefabricated tents of the related art or a support frame used in integrated tents of the related art.

In this state, in the present embodiment, the separate mat-type storage package 300 is additionally provided.

The mat-type storage package 300 in the present embodiment is a component that functions as a package used when storing and transporting the disassembled tent main body 100 and as an external mat such as a mat by being assembled around the tent main body 100 when the tent is assembled.

The mat-type storage package 300 includes again a mat main body 310, first detachable members 320, and an opening and closing member 330.

Among these, the mat main body 310 performs a storage function in addition to an actual mat function, a is in the shape of a mat having a certain overall area and including a similar or identical material to the tent main body 100, and is located in an unfolded state on the ground around the entrance 120 outside the tent main body 100.

For reference, the drawing show that the mat main body 310 is located only in front of the entrance 120 formed on the front side portion of the tent main body 100, but the location of the mat main body 310 is not limited thereto and may be selected and applied, such as being assembled around each of the entrances 120 of the tent main body 100.

The following description will be given based on the case where mat-type storage package 300 is formed in front of the entrance 120 on the front side portion as shown in the drawings.

In the mat main body 310 located above, a concave curved portion 312 concavely recessed toward the opposite side of the tent main body 100 with a similar or identical curvature to the convex curved portion 140 of the tent main body 100 is formed at an end facing the tent main body 100.

Also, the mat main body 310 is not made of a single piece of cloth, but with one edge section open, and a storage space 313 for storing the disassembled tent main body 100 is formed inside the mat main body 310.

The opening and closing member 330 is for opening and closing the storage space 313 of the mat main body 310, is formed along an opening point corresponding to an entrance of the storage space 313 in the front edge of the mat main body 310 and may be applied in various forms such as a slide fastener, a button, or a Velcro tape.

For reference, a formation location of the opening and closing member 330 is not limited to the front of the mat main body 310, but may be formed on the left and right sides or the rear side according to a formation structure of the storage space 313.

Figure 5A:
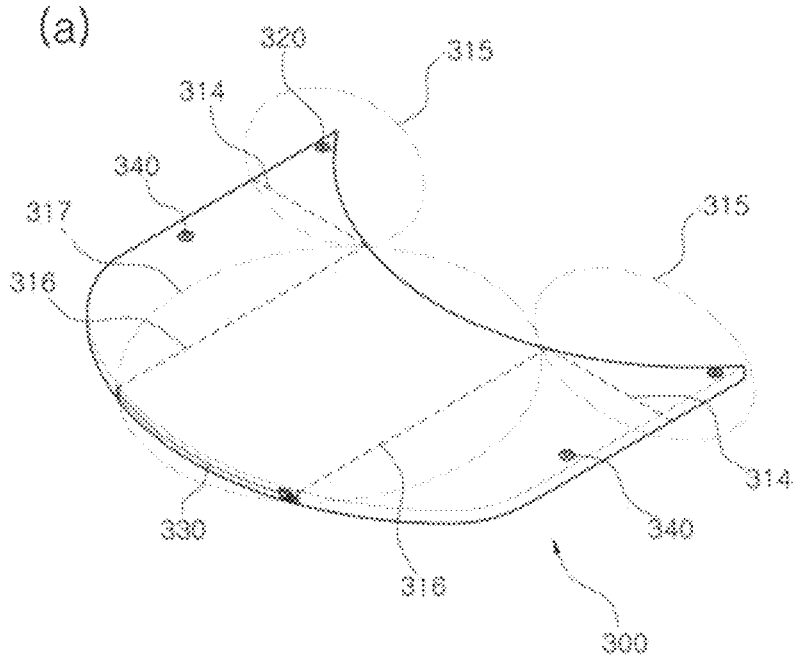
FIG. 5A is a perspective view of a mat-type storage package.
Figure 5B:
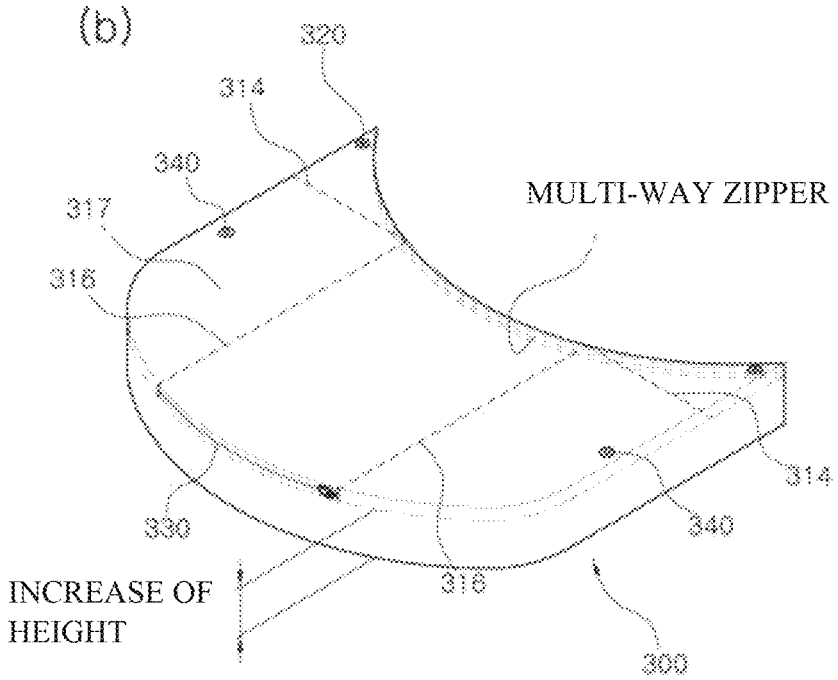
FIG. 5B is a perspective view showing a top and bottom height adjustment structure of the mat-type storage package.
Figure 6:
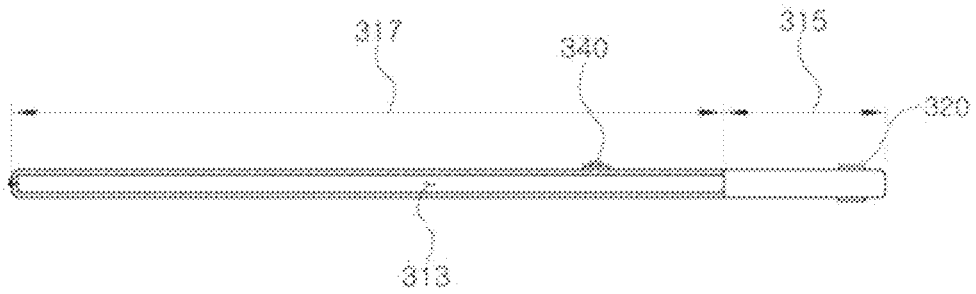
Figure 7:
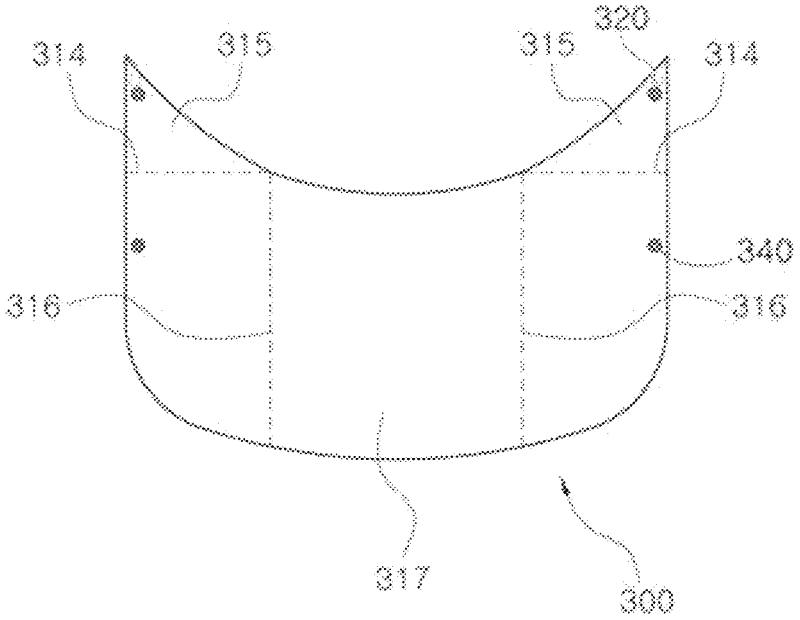

In addition, the height of the storage space 313 may be adjusted to expand the volume thereof, and accordingly, the tent main body 100 may be easily stored. Specifically, as shown in [FIG. 5B], a height part of the storage space 313 may include an expandable multi-way zipper (e.g., 2-way zipper, etc.) to increase or decrease the width of the height part. This may be similar to a method of expanding a travel carrier.

Such a structure for expanding the volume of the storage space 313 described above may be implemented by simply applying an edge surface of the mat-type storage package 300 to a folded shape or a corrugated shape, in addition to the zipper shape.

The first detachable members 320 are elements for integrally coupling the entire mat-type storage package 300 to the tent main body 100, and are formed at both left and right ends of the concave curved portion 312 of the mat main body 310 facing the tent main body 100.

For reference, the first detachable members 320 are not limited to a specific shape, and may be applied in various ways, such as a snap button or a Velcro tape, to suit the shape of the mat connecting members 150 of the tent main body 100.

Due to such a structure, the mat-type storage package 300 in the present embodiment has a thin pouch shape as a whole.

In this state, the mat main body 310 is integrated with the tent main body 100 as the first detachable members 320 are coupled to the mat connecting members 150 while the concave curved portion 312 is located to be in close contact with the convex curved portion 140 of the tent main body 100.

Therefore, a sense of unity may be increased without generating a gap at a boundary between the mat main body 310 and the tent main body 100, as well as the risk of loss of the mat-type storage package 300 during the use process may be prevented.

In this state, the mat-type storage package 300 may be transformed into a bag structure to facilitate transportation when the disassembled tent main body 100 is folded and stored.

To this end, first, first mat folding lines 314 for forming handle portions 318 to be described below are formed on an upper surface of the mat main body 310 in the shape that crosses the concave curved portion 312 in a transverse direction.

At this time, sections of the rear side of the mat main body 310 with respect to the first mat folding lines 314, that is, facing the tent main body 100, are handle portion formation sections 315 for forming the handle portions 318 later.

The handle portion forming sections 315 formed as described above are folded by rotating in a direction of the front side with respect to the first mat folding lines 314, that is, in a direction opposite to the tent main body 100, in a process of forming the handle portions 318 later.

In addition, second mat folding lines 316 are formed from both intersections between the first mat folding lines 314 and the concave curved portion 312 on the upper surface of the mat main body 310 toward the front, that is, in a direction perpendicular to the first mat folding lines 314.

That is, both the second mat folding lines 316 are formed in a horizontal state at points symmetrical to each other with left and right intervals with respect to a middle point of the concave curved portion 312.

At this time, a section of the mat main body 310 between the concave curved portion 312 and both the second mat folding lines 316 becomes a storage portion formation section 317 that forms a substantial storage portion 319 when the mat main body 310 is transformed into the shape of a bag later.

The storage portion formation section 317 formed as described above is transformed into the substantial storage portion 319 when left and right sides of the mat main body 310 are rotated and folded toward each other with respect to both second mat folding lines 316 during the process of transforming the mat main body 310 into the shape of a bag later.

Also, at points where the first detachable members 320 are seated when the handle forming section 315 on the upper surface of the mat main body 310 is rotated and folded with respect to the first mat folding lines 314, second detachable members 340 which are fastened to the first detachable members 320 such that the handle portions 318 are simultaneously formed and maintained are formed.

The second detachable members 340 may be selected and applied to have various types of fastening structures according to the shapes of the first detachable members 320.

Hereinafter, the operation of the present embodiment described above will be described.

First, as the mat main body 310 is spread out on the ground in front of the front entrance 120 of the assembled tent main body 100 and both first detachable members 320 of the mat main body 310 are fastened to both mat connecting members 150 of the tent main body 100, the mat-type storage package 300 may function as an outdoor mat while being integrated with the tent main body 100.

In addition, as mentioned above, because the concave curved portion 312 of the mat main body 310 is in close contact with the convex curved portion 140 of the tent main body 100 at the same curvature, a phenomenon in which a boundary point between the mat main body 310 and the tent main body 100 is wrinkled or a gap therebetween widens may be minimized.

When disassembling the tent in this state, first, fastening between the first detachable members 320 and the mat connecting members 150 is released to separate the mat main body 310 from the tent main body 100, and then the tent main body 100 is folded to minimize its volume.

Figure 8A:
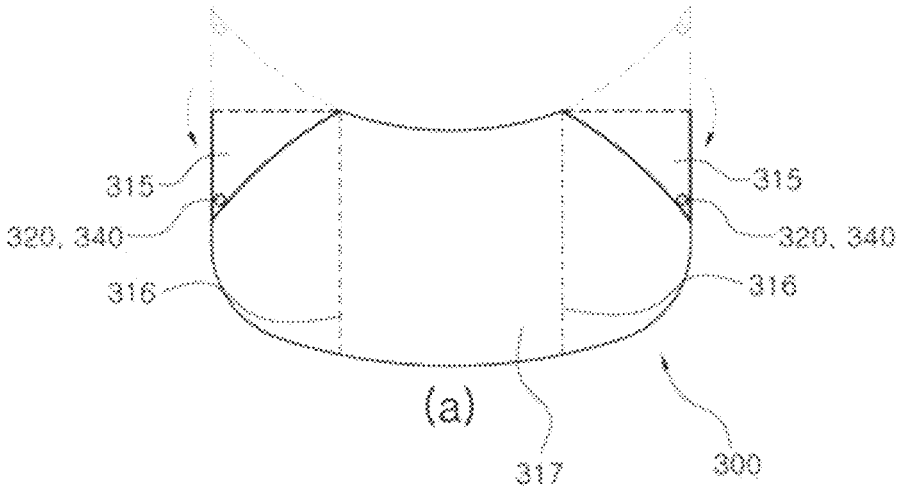
FIGS. 8A, 8B, 9A, 9B, 9C and 9D are views showing a folding process of transforming the mat-type storage package into the shape of a bag.
Figure 8B:
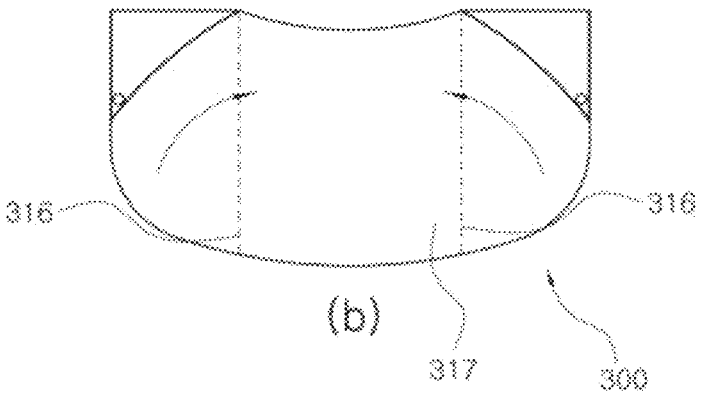

Thereafter, as shown in [FIG. 8A] and [FIG. 8B], the storage space 313 is opened through the opening and closing member 330 of the mat main body 310, and then the handle forming section 315 is folded to fasten the first detachable members 320 to the second detachable members 340, such that the handle portions 318 in the shape of a ring are formed on left and right sides.

Figure 9A:
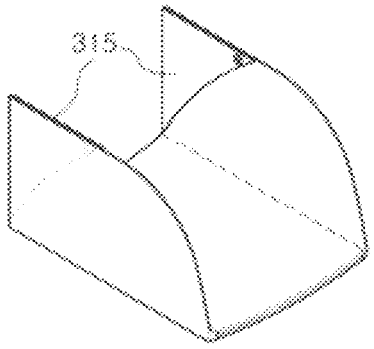
Figure 9B:
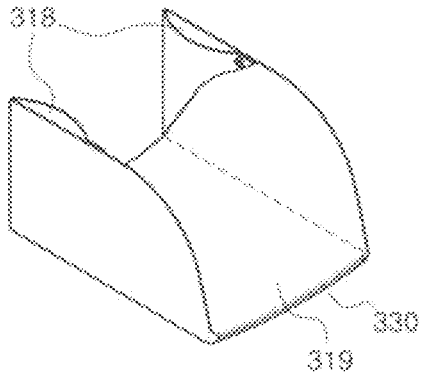
Figure 9C:
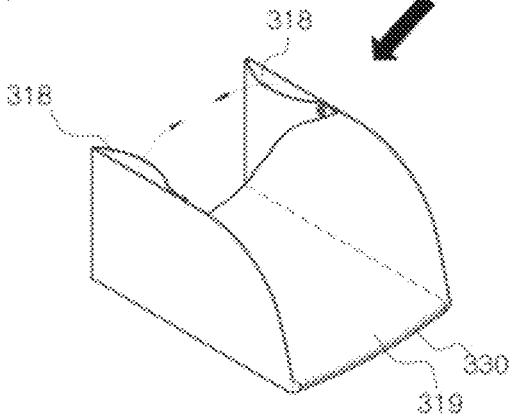

In this state, as shown in [FIG. 9A] to [FIG. 9C], when left and right sections of the mat main body 310 are folded and raised with respect to the second mat folding lines 316, the storage portion 319 in which the tent main body 100 is to be substantially accommodated is formed at a point between both second mat folding lines 316.

In this state, when the tent main body 100 is inserted into the storage space 313 within the storage portion 319, an entrance of the storage section 319 is closed with the opening and closing member 330, and both handle portions 318 are held at the same time, as shown in the drawings, the entire mat-type storage package 300 has the shape of a single bag, which makes transportation and storage much easier.

Figure 9D:
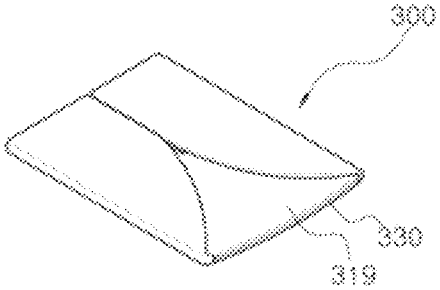

Also, in this state, as shown in [FIG. 9D], when both sections where the handle portions 318 are formed are completely folded toward each other with respect to both second mat folding lines 316, the volume of the mat-type storage package 300 is minimized.

Figure 21:
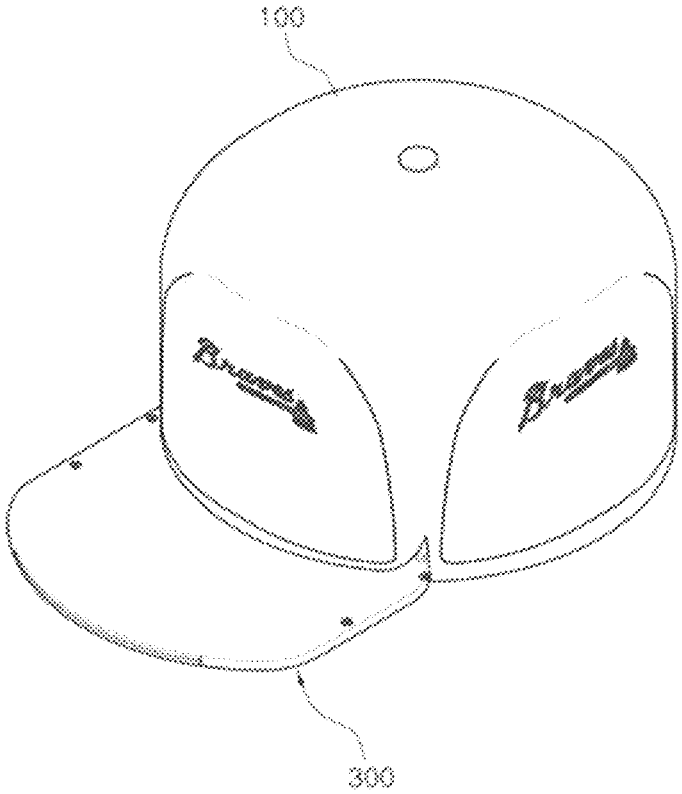
FIG. 21 is a perspective view showing a surface of the tent main body on which a logo is formed.

For reference, due to the connection structure between the tent main body 100 and the mat-type storage package 300 described above, the tent main body 100 and the mat-type storage package 300 have the overall shape of a cap. In this state, as shown in [FIG. 21], various logos (e.g., a baseball team logo to express a baseball cap) or letters related to the cap may be displayed on the surface of the tent main body 100 to make the appearance of the tent more prominent.

This is because the popularity of domestic and foreign professional baseball, professional basketball, and professional soccer has been increasing recently, and in particular, it is absolutely necessary for each club to promote the club and its league, when the logo of the club or the logo of the affiliated league is printed on a product used by consumers with a wide age range and active tendencies, as in the present disclosure, not only may this be used as means to increase promotional effect, but this may also serve as a catalyst to motivate consumers to purchase the product of the present disclosure.

Second Embodiment

Figure 10:
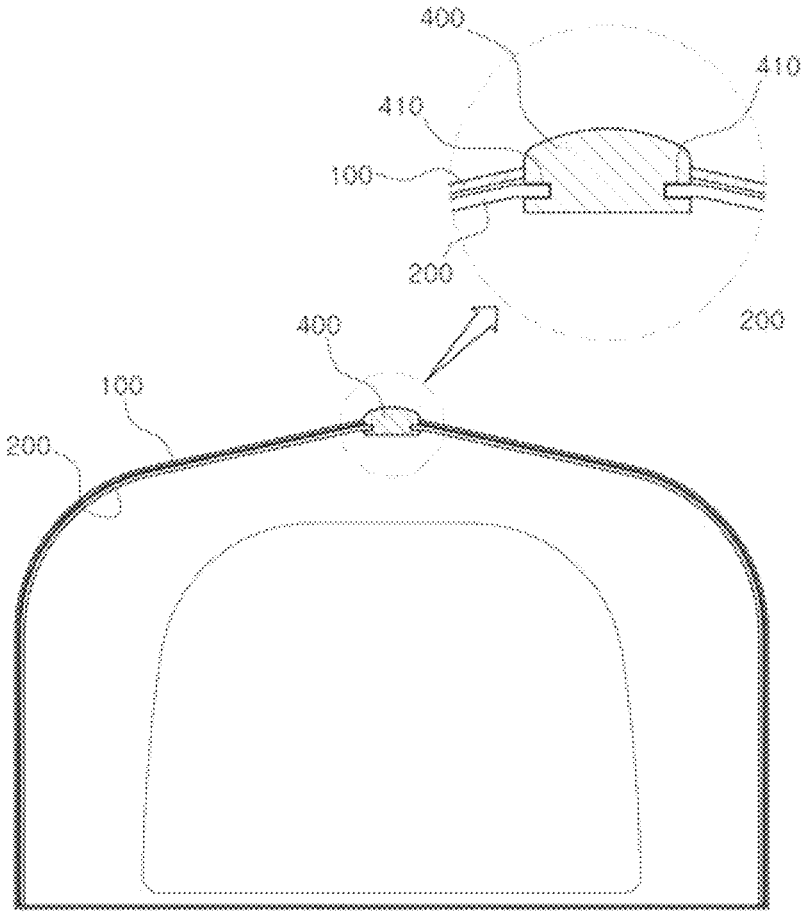
Figure 11:
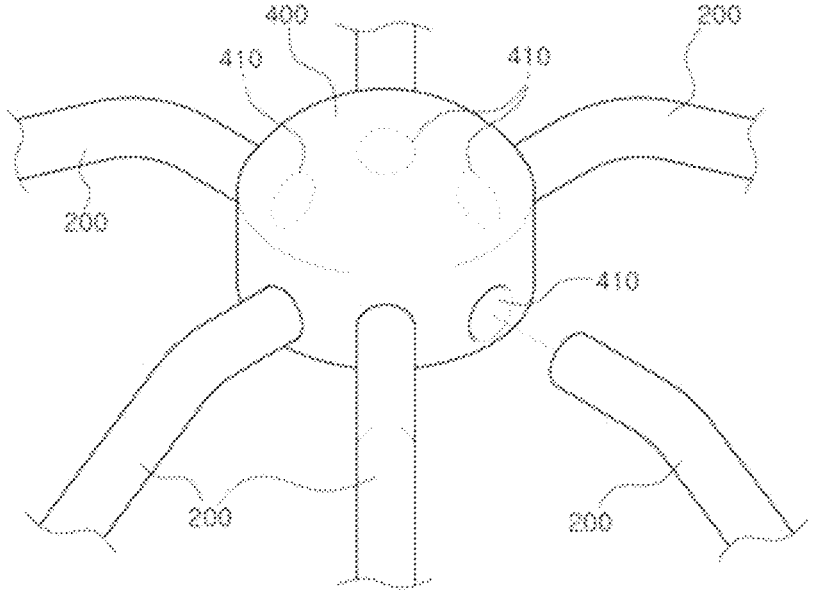

The present embodiment is the same as the first embodiment above in the technical concept and configuration of applying the mat-type storage package 300, but is different in that the assembling structure of the support frames 200 is improved such that the case of assembling and disassembling of the tent is enhanced as shown in [FIG. 10] and [FIG. 11].

More specifically, as in the first embodiment, the support frames 200 are basically assembled on the tent main body 100, the mat-type storage package 300 is connectively assembled to be separable from the tent main body 100, and a central frame coupling portion 400 is additionally provided.

The central frame coupling portion 400 is an element that acts as a medium to simultaneously connect the support frames 200 to each other and guides the overall assembling and disassembling process of the support frames 200 to be simple and quick.

The central frame coupling portion 400 is in the shape of an overall circular block, and has fastening portions 410 in the shape of a groove arranged on a circumferential surface thereof at intervals from each other for simultaneous coupling with the support frames 200.

In this state, the central frame coupling portion 400 is located at the center of an upper end of the tent main body 100 and integrally connected to the tent main body 100.

At this time, the central frame coupling portion 400 may be assembled to penetrate the tent main body 100 up and down or to be attached to the upper surface of the tent main body 100. The assembling structure of the central frame coupling portion 400 is selected and applied according to whether the support frames 200 are located outside or inside the tent main body 100.

For reference, the shape of the central frame coupling portion 400 is not limited to the shape of the circular block shown in the drawing, but may be selected and applied in various ways as long as the fastening portions 410 are formed to simultaneously connect the support frames 200.

The support frames 200 in the embodiment have the overall shape of a long bar, are located to be in close contact with or inserted into an inner surface of the tent main body 100, and are arranged in a plurality of circles at intervals in all directions with respect to the central frame coupling portion 400.

In this state, as the support frames 200 are located to cross from the upper center of the tent main body 100 through one side to the lower end, the support force of the support frames 200 may be uniformly applied over the entire area of the tent main body 100.

In other words, upper ends of the support frames 200 are located in a circular arrangement with respect to the central frame coupling portion 400, and in this state, the upper ends of the support frames 200 are respectively inserted into and coupled to the fastening portions 410 of the central frame coupling portion 400.

Therefore, the support frames 200 are simultaneously connected to each other at the upper center of the tent main body 100 through the one central frame coupling portion 400, and as a result, the support force of the tent according to the present embodiment by the support frames 200 may be uniformly distributed throughout the tent with respect to the central frame coupling portion 400.

In addition, in the process of assembling the support frames 200, the support frames 200 may be simultaneously connected to each other by simply being coupled to the one central frame coupling portion 400 simultaneously, and thus, the assembling process of the tent may be performed easily and quickly.

In addition, to the contrary, in the process of disassembling the tent, the connection between the support frames 200 is released simply by separating the support frames 200 from the central frame coupling portion 400, and thus, the disassembling process may be performed easily and quickly.

For reference, it is shown in the drawings that the fastening portions 410 of the central frame coupling portion 400 have the shapes of the simple groove, but the shapes of the fastening portions 410 are not limited thereto, and may be modified in various ways as long as simultaneous fastening and separation to and from the support frames 200 are possible.

Third Embodiment

Figure 12:
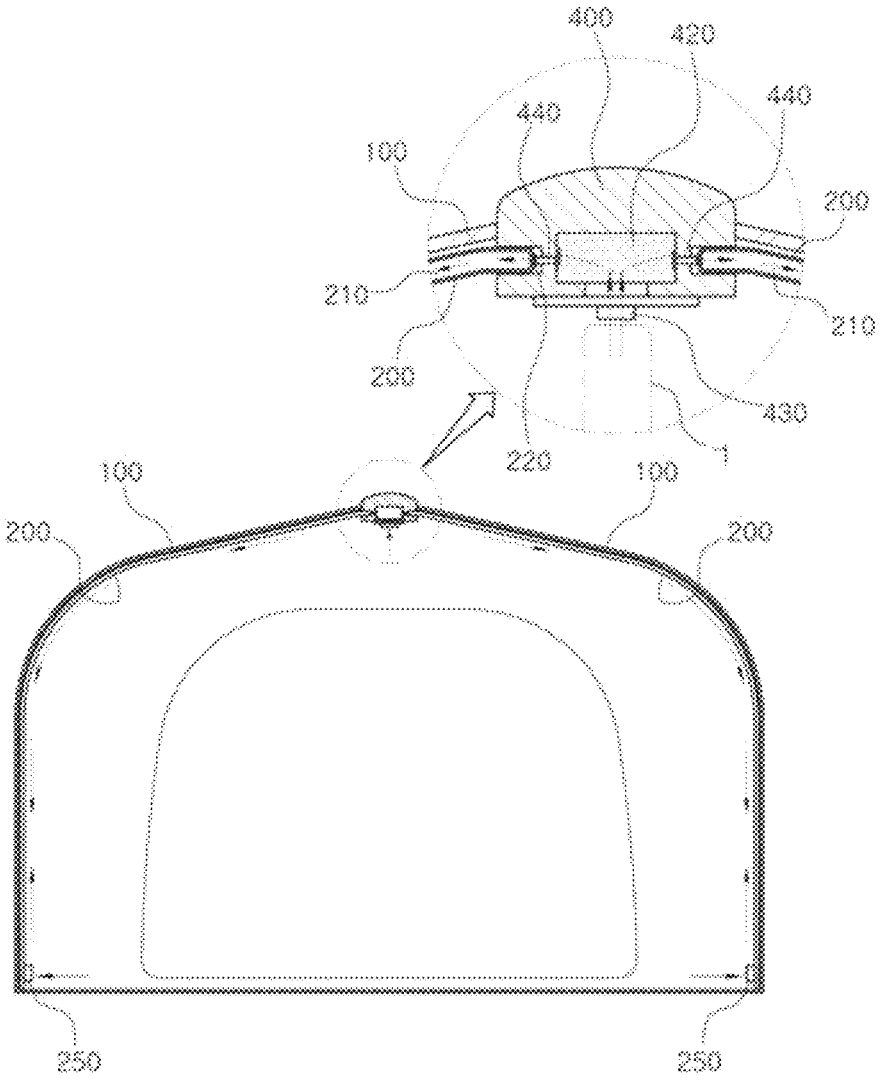
Figure 13:
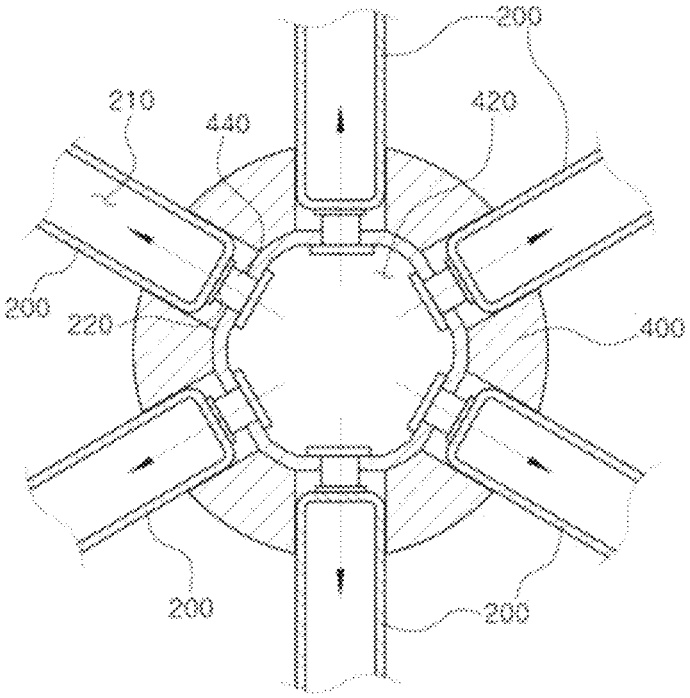
Figure 14:
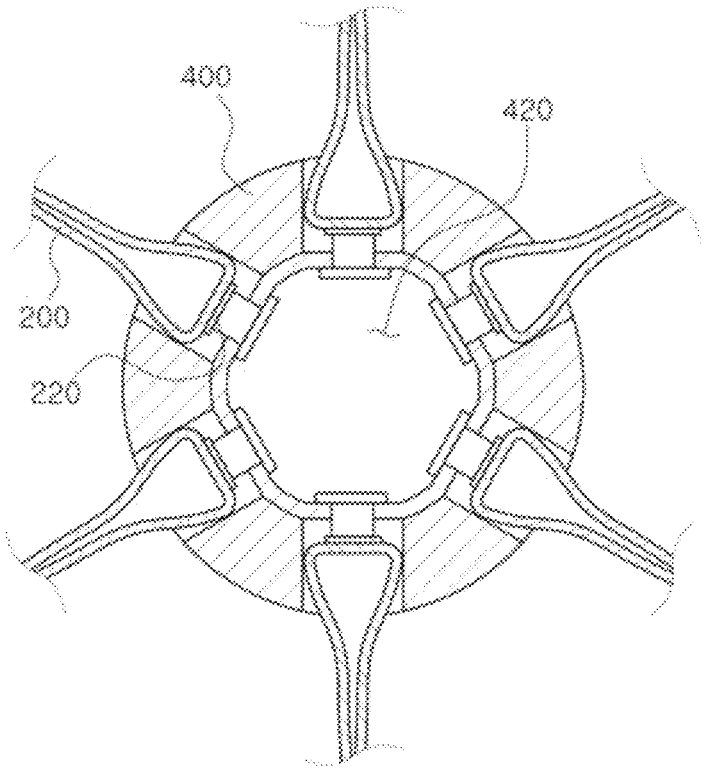

While the present embodiment has the same technical concept as the first embodiment in which the mat-type storage package 300 is applied and the second embodiment in which the central frame coupling portion 400 is additionally applied, as shown in [FIG. 12] to [FIG. 14], the present embodiment is characterized by further enhancing the case of assembling and disassembling of the tent by improving the structure of the support frames 200, as well as obtaining the effect of reducing the volume when the tent is stored after disassembled The central frame coupling portion 400 applied in the present embodiment is an element that serves to supply air to the support frames 200 in the shape of a tube to be described below, in addition to the simultaneous coupling function of the support frames 200 as in the second embodiment.

The central frame coupling portion 400 is in the shape of a circular block, has the fastening portions 410 in the shape of a groove arranged on a circumferential surface thereof at intervals from each other for simultaneous coupling with the support frames 200, and is located at the central point of an upper end of the tent main body 100 as in the second embodiment.

At this time, an air distribution space 420 is formed inside the central frame coupling portion 400, and a main air injection/discharge port for supplying or withdrawing external air into or from the air distribution space 420 is formed in a lower surface of the central frame coupling portion 400.

Also, inside each of the fastening portions 410, an air nozzle 440 for supplying the air in the air distribution space 420 into the support frame 200 to be described below or for withdrawing the air in the support frame 200 into the air distribution space 420 is located in communication with the air distribution space 420.

The support frame 200 in the present embodiment is in the shape of a bar with a certain length, made of synthetic resin such as rubber or vinyl, and in the shape of a tube with an air filling space 210 formed therein.

The support frames 200 are located to be in close contact with or inserted into an inner surface of the tent main body 100 and arranged in a plurality of circles at intervals in all directions with respect to the central frame coupling portion 400 with upper ends facing the fastening portions 410 of the central frame coupling portion 40 as in the second embodiment.

At this time, an air inflow hole 220 is formed in the upper end of each of the support frames 200 through which the central frame coupling portion 400 may pass, and in this state, the upper end of each of the support frames 200 is inserted into each of the fastening portions 410 of the central frame coupling portion 400, and at the same time, the air nozzle 440 in each of the fastening portions 410 is penetrated and inserted into the air inflow hole 220 of each of the support frames 200.

Hereinafter, the operation of the present embodiment will be described.

First, because the air filling space 210 in each of the support frames 200 is not filled with air before assembling the tent, the support frame 200 does not have the shape of a standardized bar but is located in the shape of crumpled vinyl.

Therefore, even though the support frames 200 are not separated from the tent main body 100, the tent main body 100 may be easily folded and disassembled as well as the overall volume does not increase, and thus, compared to the prefabricated tents of the related art that separately use the support frames 200, the space consumption rate is much reduced when the tent is stored.

In the process of assembling the tent, when a user supplies air by coupling an air injection pump 1 to the main air injection/discharge port 430 of the central frame coupling portion 400, the supplied air is supplied to the air filling space 210 of each of the support frames 200 through the air nozzle 440 in each of the fastening portions 410 while being accommodated in the air distribution space 420.

As a result, the support frames 200 simultaneously expand in volume to have the shape of a bar, and at the same time, a support force is applied.

As described above, while the support frames 200 are coupled to the tent main body 100, the support frames 200 may function as support frames simply through injection of air, and thus, the assembling process may be performed much more easily and quickly compared to the prefabricated tents of the related art.

In addition, because each of the support frames 200 is tightly expanded by internal air pressure, the support force of the support frame 200 is increased compared to the prefabricated tents of the related art.

In other words, by implementing the support frame 200 in the shape of an air tube, there are the effects that assembling and disassembling of the tent may be made much more easily and quickly compared to the prefabricated tents of the related art, the volume may be minimized when the tent is stored, and a higher support force may be obtained compared to the prefabricated tents of the related art.

Also, as shown in the drawings, by forming separate individual air injection/discharge ports 250 for each of the support frames 200, if necessary, air may be injected through the central frame coupling portion 400, and air may be additionally injected through the individual air injection/discharge ports 250, and thus, the air filling time may be shortened.

In addition, even if the central frame coupling portion 400 is damaged and may not perform the air supply function, air may be injected through the individual air injection/discharge ports 250.

For reference, the main air injection/discharge port 430 of the central frame coupling portion 400 and the individual air injection/discharge ports 250 of the support frame 200 are in the shape of a nozzle capable of both injection and discharge of air, and a known nozzle applicable to a general air tub may be applied.

Fourth Embodiment

The present embodiment is characterized in that the support frame 200 is implemented in the shape of an air tube as in the third embodiment but in the shape of a multi-tube.

Figure 15:
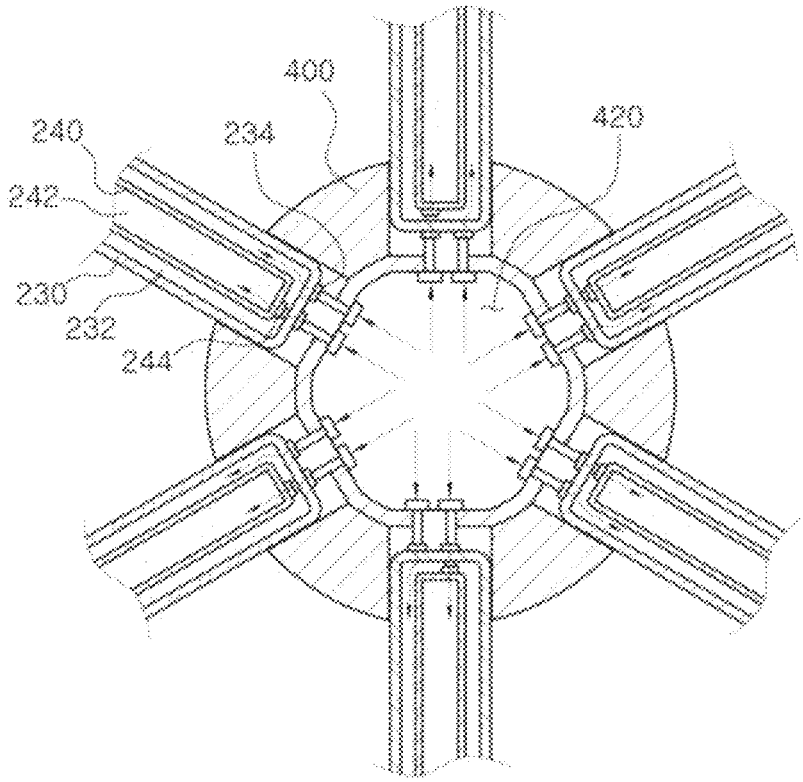
FIG. 15 is a diagram of a fourth embodiment, and a plan sectional view showing a coupling structure between each of support frames implemented in the shape of a multi-tube and a central frame coupling portion.

That is, as shown in [FIG. 15], the support frame 200 of the present embodiment includes a first tube 230 and a second tube 240.

First, the first tube 230 serves as an internal frame of the support frame 200, and is in the shape that a first air filling space 232 is formed inside and a first air inflow hole 234 is formed in an upper end.

Also, the second tube 240 generally has the shape of surrounding the first tube 230 from the outside, a second air filling space 242 in which the first tube 230 is accommodated is formed inside, and a second air inflow hole 244 is formed in an upper end.

In this state, an upper end of the support frame 200 is inserted into each of the fastening portion 410 of the central frame coupling portion 400, and at this time, the two air nozzles 440 are provided in each of the fastening portion 410 of the central frame coupling portion 400 and are individually penetrated and connected to the first air inflow hole 234 and the second air inflow hole 244 of each of the support frames 200.

As a result, air supplied through the central frame coupling portion 400 is individually supplied and filled to the first tube 230 and the second tube 240 of each of the support frames 200.

As the support frame 200 is implemented in the shape of the multi-tube as described above, the second tube 240 may maintain a support force even though the outer first tube 230 is damaged and air is lost due to an unnecessary contact during a use or storage process.

Fifth Embodiment

The present embodiment is characterized by applying the folding structure of the tent main body 100 in the first embodiment such that the tent main body 100 may be easily and quickly stored in the mat-type storage package 300 during the process of disassembling the tent main body 100.

Figure 16:
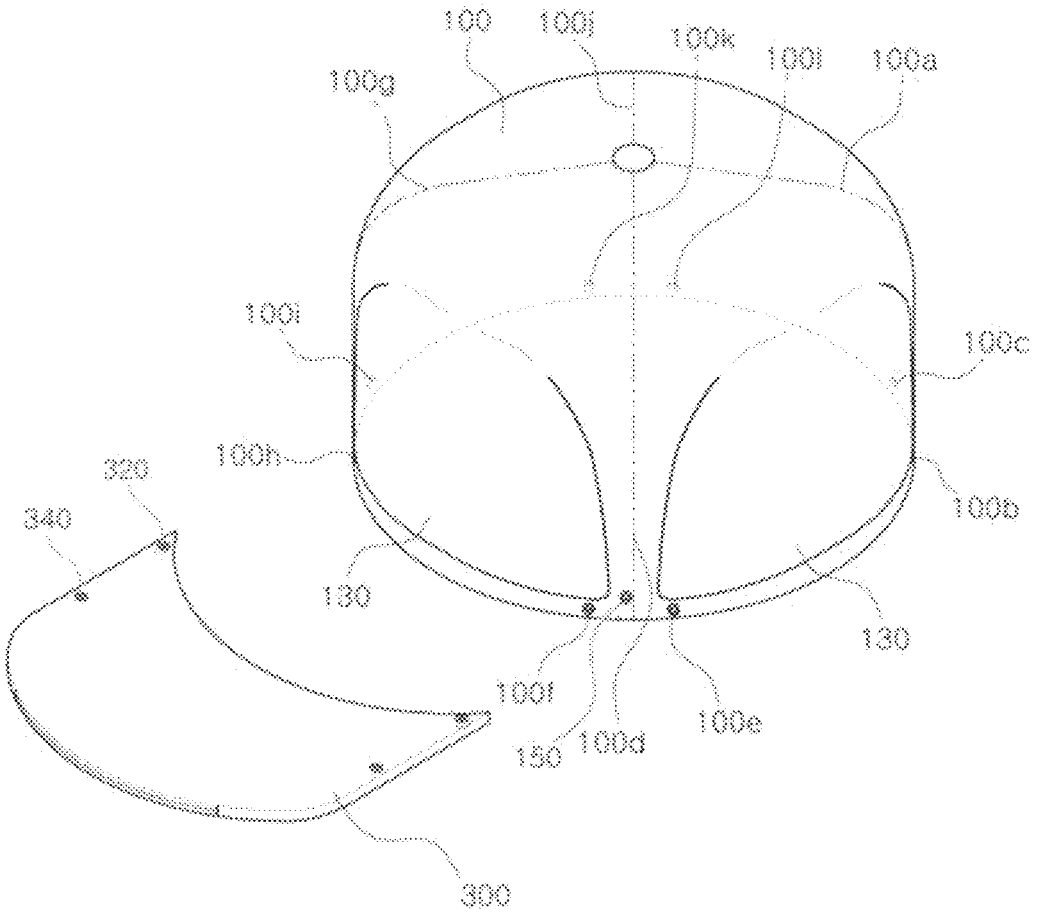
Figure 17:
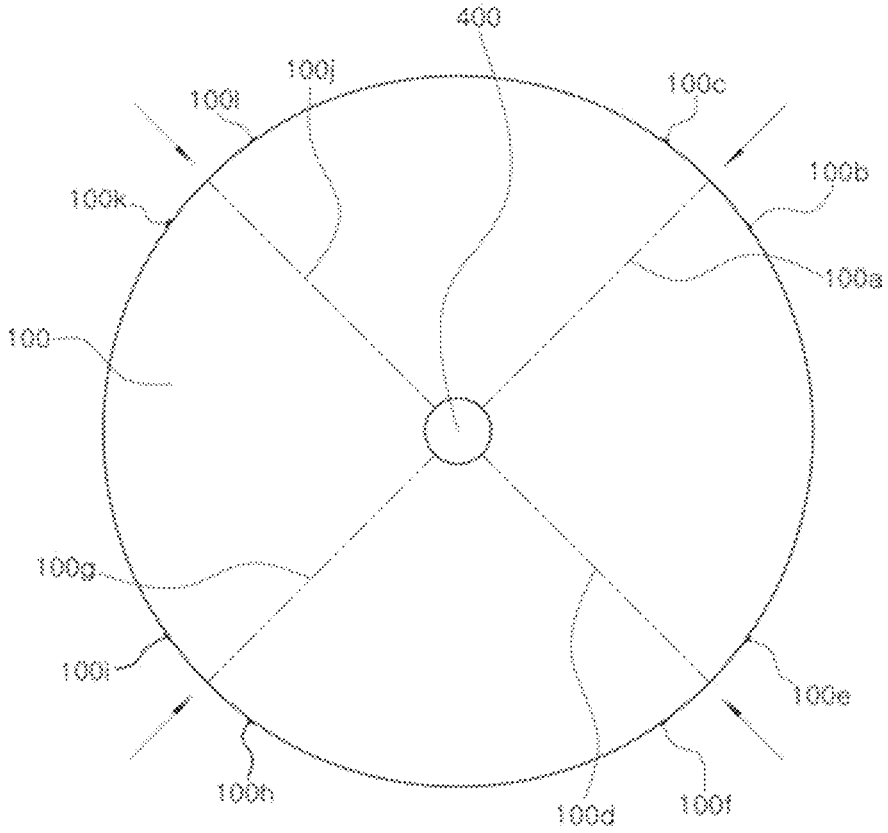
Figure 18:
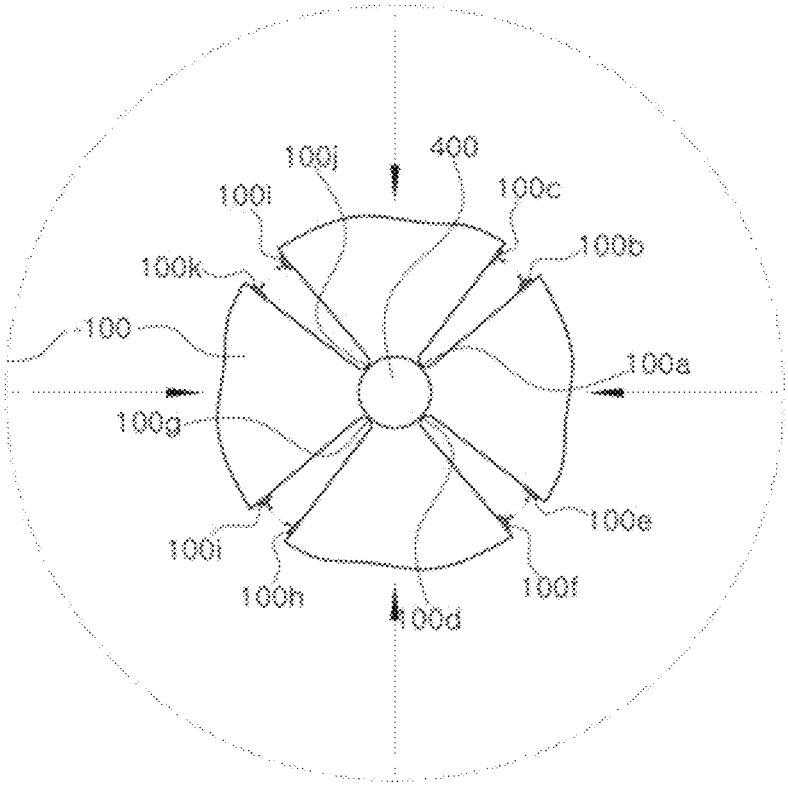
Figure 19A:
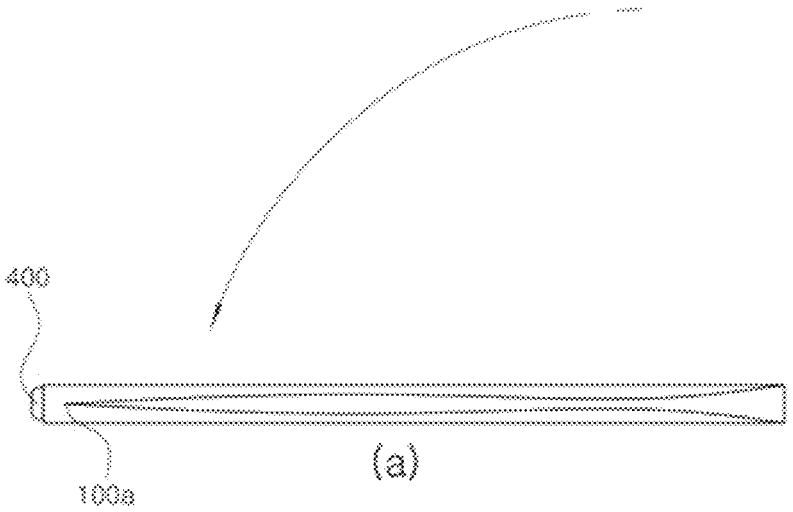
FIGS. 19A and 19B are side schematic views showing the tent main body folded in half while lying on the ground in the state of FIG. 18.
Figure 19B:
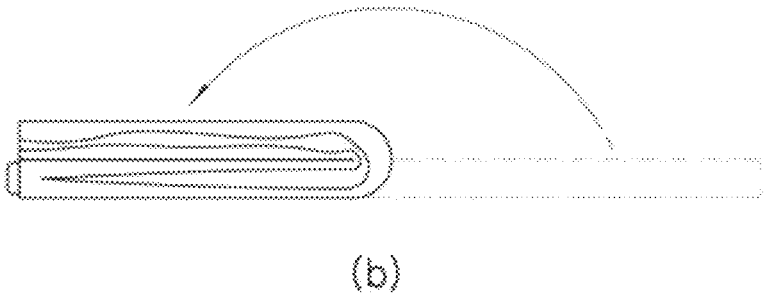

To this end, the tent main body 100 has basically the same configuration as that described in the first embodiment, but as shown in [FIG. 16] to [FIG. 19], a first tent folding line 100*a* and a third tent folding line 100*g* are formed in a left-right symmetrical shape from a central point of an upper end of the tent main body 100 to lower ends of one side and the other side, and a second tent folding line 100*d* and a fourth tent folding line 100*j* are formed to the lower ends of one side and the other side in the shape of intersecting each other at points left-right symmetrical with the first tent folding line 100*a* and the third tent folding line 100*g*.

Also, a first folding fixing member 100*b* and a second folding fixing member 100*c* that may be fastened to and separated from each other are formed at points symmetrical on both sides of an outer surface of the tent main body 100 with the first tent folding line 100*a* therebetween.

For reference, the first folding fixing member 100*b* and the second folding fixing member 100*c* may be implemented in the shape of snap buttons as shown in the drawings, or may be selected and applied in the shape such as Velcro tapes that may be easily fastened to and separated from each other.

Also, a third folding fixing member 100*e* and a fourth folding fixing member 100*f* that have the same shapes as the first folding fixing member 100*b* and the fourth folding fixing member 100*f* and may be fastened to and separated from each other are formed at points symmetrical on both sides of the outer surface of the tent main body 100 with the second tent folding line 100*d* therebetween.

Also, a fifth folding fixing member 100*h* and a sixth folding fixing member 100*i* that have the same shapes as the third folding fixing member 100*e* and the fourth folding fixing member 100*f* and may be fastened to and separated from each other are formed at points symmetrical on both sides of the outer surface of the tent main body 100 with the third tent folding line 100*g* therebetween.

In addition, a seventh folding fixing member 100*k* and an eighth folding fixing member 100*l* that have the same shapes as the fifth folding fixing member 100*h* and the sixth folding fixing member 100*i* and may be fastened to and separated from each other are formed at points symmetrical on both sides of the outer surface of the tent main body 100 with the fourth tent folding line 100*j* therebetween.

According to such a structure, in the process of disassembling the tent, first, while pushing a formation point of the first tent folding line 100*a* of the tent main body 100 toward the center of the tent main body 100, points on both sides with respect to the first tent folding line 100*a* are folded toward each other, and then the first folding fixing member 100*b* and the second folding fixing member 100*c* are fastened to each other, and thus, the folding state at the corresponding points is maintained.

Then, while pushing a formation point of the second tent folding line 100*d* of the tent main body 100 toward the center of the tent main body 100, points on both sides with respect to the second tent folding line 100*d* are folded toward each other, and then the third folding fixing member 100*e* and the fourth folding fixing member 100*f* are fastened to each other, and thus, the folding state at the corresponding points is maintained.

In addition, while pushing a forming point of the third tent folding line 100*g* of the tent main body 100 toward the center of the tent main body 100, points on both sides with respect to the third tent folding line 100*g* are folded towards each other, and then the fifth folding fixing member 100*h* and the sixth folding fixing member 100*i* are fastened to each other, and thus, the folding state at the corresponding points is maintained.

Also, while pushing a forming point of the fourth tent folding line 100*j* of the tent main body 100 toward the center of the tent main body 100, points on both sides with respect to the fourth tent folding line 100*j* are folded toward each other, and then the seventh folding fixing member 100*k* and the eighth folding fixing member 100*l* are fastened to each other, and thus, the folding state at the corresponding points is maintained.

In this state, with the entire tent main body 100 lying on the floor as shown in the drawings, the tent main body 100 is sequentially folded from the back to the front and then placed into the mat-type storage package 300 for storage.

In the present embodiment, each folding line is displayed on the tent main body 100 such that the user may easily know how to fold the tent main body 100, and thus, the tent may be easily and quickly disassembled.

For reference, the drawings show four folding lines, but in some cases, the tent main body 100 may include six or other number of folding lines.

Also, in this state, the tent main body 100 may be received and stored directly in the mat-type storage package 300, and thus, the receiving and storage process may be much easier.

What is claimed is:

1. A cap shaped tent comprising:

a tent main body located in a shape surrounding a usable space in a center and having entrances and opening and closing doors for opening and closing the usable space formed in side portions;

support frames in a shape of a bar and connected to each other in a shape of surrounding the usable space while contacting a surface of the tent main body and supporting the tent main body; and a mat storage package located in an unfolded shape on a ground outside the entrances of the tent main body, and having one side portion connected to be separable from the tent main body and a storage space formed inside, wherein the tent main body is stored in the storage space of the mat storage package in a folded state, the mat storage package further comprises mat connecting members formed on the surface of the tent main body, the mat storage package comprises:

a mat main body in which the storage space is formed;

first detachable members formed on the mat main body and coupled to be separable from the mat connecting members; and an opening and closing member formed on an edge of the mat main body to open and close the storage space, and the mat storage package comprises handle portions formed by folding a part of the mat main body and a storage portion in which the storage space is formed.

2. The cap shaped tent of claim 1, further comprising a central frame coupling portion located at an upper center of the tent main body and having fastening portions formed on an edge in all directions, wherein the support frames are simultaneously connected to and support side and upper surfaces of the tent main body, have upper ends fastened to the fastening portions of the central frame coupling portion, and are located in a shape of extending in all directions with respect to the central frame coupling portion.

3. The cap shaped tent of claim 2, wherein the central frame coupling portion has a main air injection/discharge port formed in one side, and an air distribution space communicating with the main air injection/discharge port formed inside, and the fastening portions are in a shape of a nozzle communicating with the air distribution space and discharging air, each of the support frames is in a shape of an air tube with an air filling space formed therein, and an air inflow hole formed in an upper end is communicatively connected to each of the fastening portions, and external air supplied through the main air injection/discharge port is supplied to each of the support frames through the air distribution space, each of the fastening portions, and the air inflow hole such that a volume of each of the support frames expands to support the tent main body.

4. The cap shaped tent of claim 3, wherein individual air injection/discharge ports capable of directly injecting air into the air filling space are formed on side portions of each of the support frames.

5. The cap shaped tent of claim 3, wherein the support frames are in a shape of a multi-tube including a first tube having a first air filling space formed therein and connected to each of the fastening portions of the central frame coupling portion, and a second tube surrounding the first tube, having a second air filling space formed inside, and connected to each of the fastening portions of the central frame coupling portion, and the air inflow hole is divided into a first air inflow hole formed in the first tube and connected to each of the fastening portions of the central frame coupling portion, and a second air inflow hole formed in the second tube and connected to each of the fastening portions of the central frame coupling portion.

6. The cap shaped tent of claim 1, wherein the tent main body further comprises:

based on that a first tent folding line and a third tent folding line are formed from a central point of an upper end to lower ends of one side and the other side, a second tent folding line and a fourth tent folding line are formed to the lower ends of one side and the other side in a shape of intersecting each other at points left-right symmetrical with the first tent folding line and the third tent folding line, a first folding fixing member and a second folding fixing member located at both sides of an outer surface of the tent main body with the first tent folding line therebetween and fastened to and separated from each other;

a third folding fixing member and a fourth folding fixing member located at both sides of the outer surface of the tent main body with the second tent folding line therebetween and fastened to and separated from each other;

a fifth folding fixing member and a sixth folding fixing member located at both sides of the outer surface of the tent main body with the third tent folding line therebetween and fastened to and separated from each other; and a seventh folding fixing member and an eighth folding fixing member located at both sides of the outer surface of the tent main body with the fourth tent folding line therebetween and fastened to and separated from each other, wherein, when the tent main body is folded with respect to the first tent folding line, the second tent folding line, the third tent folding line, and the fourth tent folding line, the first to eighth folding fixing members are fastened to each other, and the tent main body is entirely disassembled in a shape of being sequentially folded from the lower end to the upper end and then stored in the storage space of the mat storage package.

7. A cap shaped mosquito net comprising:

a tent main body located in a shape surrounding a usable space in a center and having entrances and opening and closing doors for opening and closing the usable space formed in side portions;

support frames in a shape of a bar and connected to each other in a shape of surrounding the usable space while contacting a surface of the tent main body and supporting the tent main body; and a mat storage package located in an unfolded shape on a ground outside the entrances of the tent main body, and having one side portion connected to be separable from the tent main body and a storage space formed inside, wherein the tent main body is stored in the storage space of the mat storage package in a folded state, the mat storage package further comprises mat connecting members formed on the surface of the tent main body, the mat storage package comprises:

a mat main body in which the storage space is formed;

first detachable members formed on the mat main body and coupled to be separable from the mat connecting members; and an opening and closing member formed on an edge of the mat main body to open and close the storage space, and the mat storage package comprises handle portions formed by folding a part of the mat main body and a storage portion in which the storage space is formed.

* * * * *